US006627081B1

(12) United States Patent
Hilditch et al.

(10) Patent No.: US 6,627,081 B1
(45) Date of Patent: Sep. 30, 2003

(54) SEPARATOR ASSEMBLY

(75) Inventors: Michael Hilditch, Asker (NO); Martin Dennis Grewer, Evesham (GB); Geir Olsen, Oslo (NO)

(73) Assignees: Kvaerner Process Systems A.S. (NO); Kvaerner Oilfield Products A.S. (NO)

( * ) Notice: Subject to any disclaimer, the term of this patent is extended or adjusted under 35 U.S.C. 154(b) by 0 days.

(21) Appl. No.: 09/744,873

(22) PCT Filed: Jul. 30, 1999

(86) PCT No.: PCT/GB99/02497

§ 371 (c)(1),
(2), (4) Date: Mar. 28, 2001

(87) PCT Pub. No.: WO00/08302

PCT Pub. Date: Feb. 17, 2000

(30) Foreign Application Priority Data

Aug. 1, 1998 (GB) ..... 9816725

(51) Int. Cl.[7] ..... B04C 5/28; E21B 43/48

(52) U.S. Cl. ..... 210/512.2; 210/512.1; 166/265

(58) Field of Search ..... 210/512.1, 512.2; 166/265

(56) References Cited

FOREIGN PATENT DOCUMENTS

| | | | |
|---|---|---|---|
| GB | 2308995 | 7/1997 | |
| NO | 303298 B1 * | 6/1998 | ..... B29D/23/18 |
| WO | WO94/13930 | 6/1994 | |
| WO | WO96/41065 | 12/1996 | |
| WO | WO97/25150 | 7/1997 | |

OTHER PUBLICATIONS

Unofficial English Translation of Norway Patent Applcation No. P962337 by Michael Hilditch a named Inventor of P962337 Upon allowance Norway Patent Application No. P962337 became Norway Patent No. NO 303298 B1.*

* cited by examiner

*Primary Examiner*—David A. Reifsnyder
(74) *Attorney, Agent, or Firm*—Cesari and McKenna, LLP

(57) ABSTRACT

A separator assembly for use "downhole" in an oil well, comprising an elongate body member including longitudinally extending oil and water passages, the elongate body member defining a longitudinally extending mounting face to which at least one hydrocyclone is secured, the hydrocyclone having its axis extending generally longitudinally of the elongate body, a first connecting union at the overflow end of the hydrocyclone whereby the overflow outlet of the hydrocyclone communicates with the oil passage of the body member, a second connecting union at the underflow end of the hydrocyclone whereby the underflow outlet of the hydrocyclone communicates with the water passage of the elongate body member, and, connecting means at opposite axial ends respectively of the elongate body member for establishing communication with the oil and water passages respectively.

12 Claims, 4 Drawing Sheets

SEPARATOR ASSEMBLY

Figure 1:
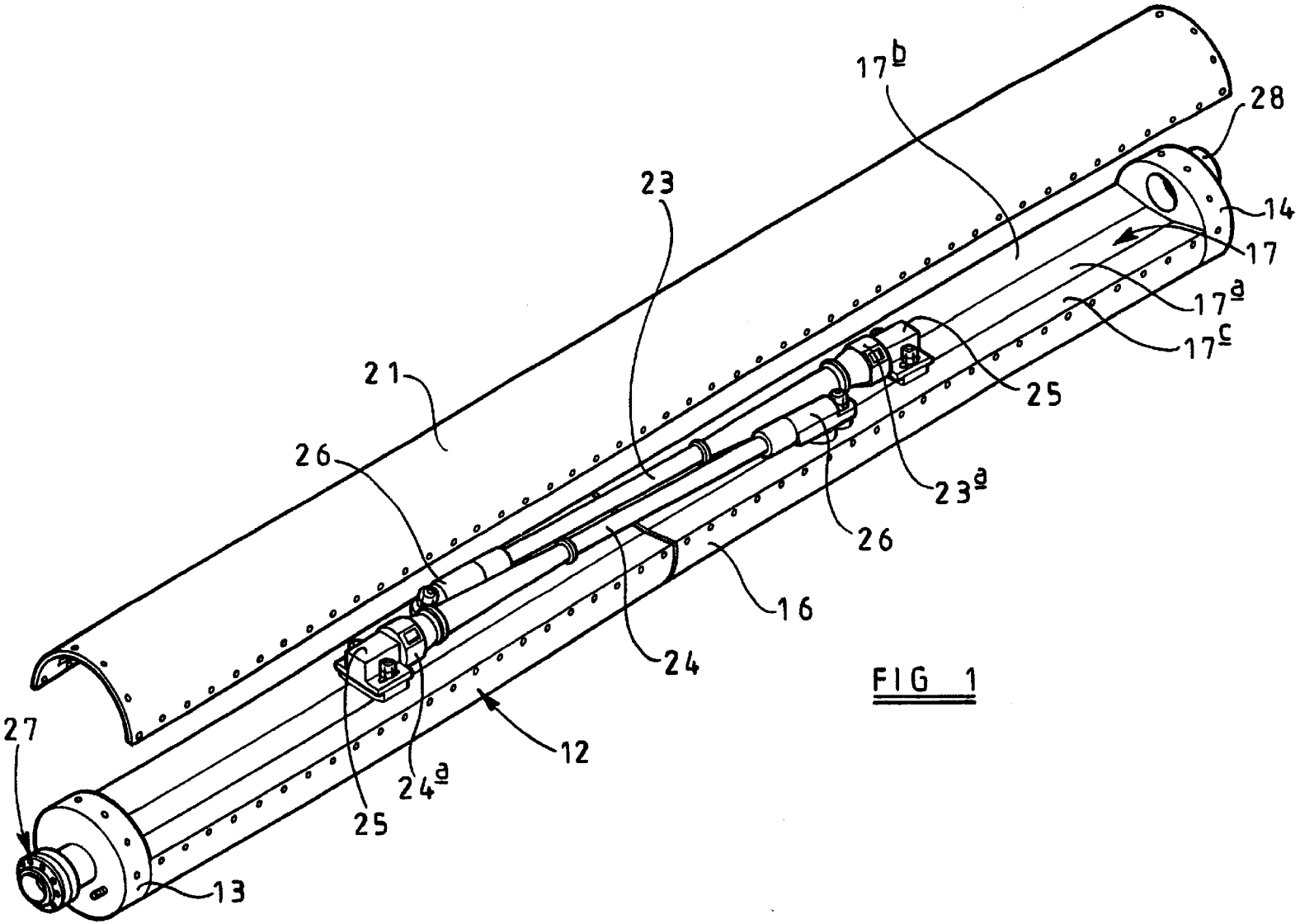

This invention relates to a separator assembly utilizing one or more hydrocyclones for use "downhole" in a hydrocarbon well for separating oil and water in a production flow from the subterranean hydrocarbon reservoir.

The use of hydrocyclones to separate oil and water from the production flow of an oil well is well known. It is also well known that hydrocyclones can be designed to operate as bulk oil/water separators which primarily are designed to separate oil from the production flow where the mixture contains a relatively high proportion of oil; pre-deoiler separators designed to separate oil from a flow where there is a lower concentration of oil, for e -ample the water and oil mixture discharged from a bulk oil/water separator; and, deoiler separators designed to operate on mixtures with a low concentration of oil in water, so as to be able to discharge substantially clean water back into the environment.

There is a significant energy wastage in transporting downhole water to a surface processing station for subsequent discharge back into the environment. Thus an objective of downhole separation is to remove water from the fluid which is transported to the surface and usually therefore downhole separation systems make use of bulk oil/water hydrocyclones, and pre-deoiler hydrocyclones.

There have been a number of prior proposals for downhole hydrocyclone separation systems. Generally such systems comprise an outer tubular structural housing dimensioned to fit closely within the fixed well casing of the oil well and providing a supporting structure for locating and securing a plurality of hydrocyclones therein. Complex piping within the housing communicates with the outlets of the hydrocyclones so that separated water can be reinjected back into the hydrocarbon reservoir by way of injection into a formation above or below the production zone, and an oil rich mixture resulting from the removal of some of the water can be transported to the surface. It has been suggested (see for example Norwegian Patent Application P962337) that the hydrocyclones may be supported by oil and water manifolds, but no mechanism for this has been disclosed.

The use of an outer cylindrical housing, containing the hydrocyclones and connecting piping, as the structural element of a separator assembly is disadvantageous in that the housing is, of necessity, a robust, large diameter component occupying a significant amount of the space available in the well casing and consequently restricting the production flow in the well casing with the attendant risk of shearing of the oil droplets in the production flow.

It is an objective of the present invention to provide a separator assembly, for use downhole, in which the aforementioned disadvantages are minimised.

In accordance with the present invention there is provided a separator assembly comprising an elongate body member including longitudinally extending oil and water passages, the elongate body member defining a longitudinally extending mounting face to which at least one hydrocyclone is secured, said hydrocyclone having its axis extending generally longitudinally of the elongate body, a first connecting union at the overflow end of the hydrocyclone whereby the overflow outlet of the hydrocyclone communicates with the oil passage of said body member, a second connecting union at the underflow end of the hydrocyclone whereby the underflow outlet of the hydrocyclone communicates with the water passage of said elongate body member, and, connecting means at opposite axial ends respectively of the elongate body member for establishing communication with said oil and water passages respectively.

Preferably said first and second connecting unions provide the means of securing the hydrocyclone to the elongate body member.

Preferably each elongate body member carries a plurality of hydrocyclones.

Preferably the or each hydrocyclone is disposed with its longitudinal axis inclined with respect to the longitudinal axis of the respective elongate body member.

Conveniently the elongate body member defines a generally transversely extending hydrocyclone mounting surface and said oil and water passages are disposed side-by-side with their axes in a plane generally parallel to the plane of said mounting surface, the spacing of the axes of said oil and water passages being so chosen in relation to the length and inclination of the hydrocyclones that said first and second connecting unions at opposite axial ends respectively of the hydrocyclone aligned with the respective oil and water passages.

Preferably the elongate body member includes a second water passage parallel to and spaced from the first water passage and the oil passage, said oil passage being disposed between said first and second water passages.

Conveniently first and second hydrocyclones are secured to the elongate body member with their longitudinal axes parallel to one another and inclined to the longitudinal axis of the body member, said hydrocyclones overlapping in side-by-side relationship and extending in opposite directions, the overflow outlets of the two hydrocyclones being aligned with one another lengthways of the body member so that their connecting unions communicate with the oil passage, while the connecting unions at the underflow ends of the two hydrocyclones communicate with the first and second water passages respectively.

Conveniently first and second hydrocyclones extending in opposite directions are secured to the elongate body with their longitudinal axes co-extensive, the hydrocyclones having their overflow outlets adjacent one another and communicating with a common connecting union connecting the two overflow outlets to the oil passage of the body.

Conveniently the axially aligned hydrocyclones have their co-extensive axes parallel to the axis of the elongate body.

Alternatively the axially aligned hydrocyclones have their co-extensive axes inclined with respect to the longitudinal axis of the elongate body such that the overflow outlets of the hydrocyclones communicate with the oil passage through said common connecting union, and the connecting unions at the underflow ends of the two hydrocyclones communicate respectively with the first and second water passages.

Preferably the elongate body member includes opposite axial end bosses of circular cylindrical form and said mounting surface of the elongate body is approximately diametric in relation to the cylindrical bosses.

Desirably the or each inlet of the or each hydrocyclone is an exposed inlet so as to accept liquid mixture flowing in the region of the mounting face of the elongate body.

Preferably where said hydrocyclones are configured to be bulk oil/water hydrocyclones the mounting surface of the elongate body member is exposed in use to the production flow within the well casing such that production flow enters the inlets of the hydrocyclones.

Alternatively where the hydrocyclones are configured to operate as pre-deoiler hydrocyclones then a cover member is sealingly engaged with the elongate body member to define with the mounting surface of the body member an inlet chamber which, in use, is flooded through an inlet passage with the underflow from bulk oil/water hydrocyclones.

The invention further resides in a downhole separator string comprising a plurality of separator assemblies as defined above interconnected with their elongate body members in end-to-end relationship.

Preferably the string includes pre-deoiler separator assemblies and bulk oil/water separator assemblies and the pre-deoiler separator assemblies are positioned lower in the string, in use, than the bulk oil/water separator assemblies, the underflow of the bulk oil/water separators passing down the string to the pre-deoiler separator assemblies, the underflow of which is disposed of by, for example, reinjection, the oil overflow of the pre-deoiler separators passing upwardly through the string to be mixed with the oil overflow of the bulk oil/water separators for transport to the surface.

Preferably the body member of each of the bulk oil/water separator assemblies includes an additional oil passage through which oil from pre-deoiler separator assemblies lower down the string is transported upwardly.

Conveniently said further oil passage is housed within the first mentioned oil passage of the elongate body member of the bulk oil/water separator assemblies.

Figure 2:
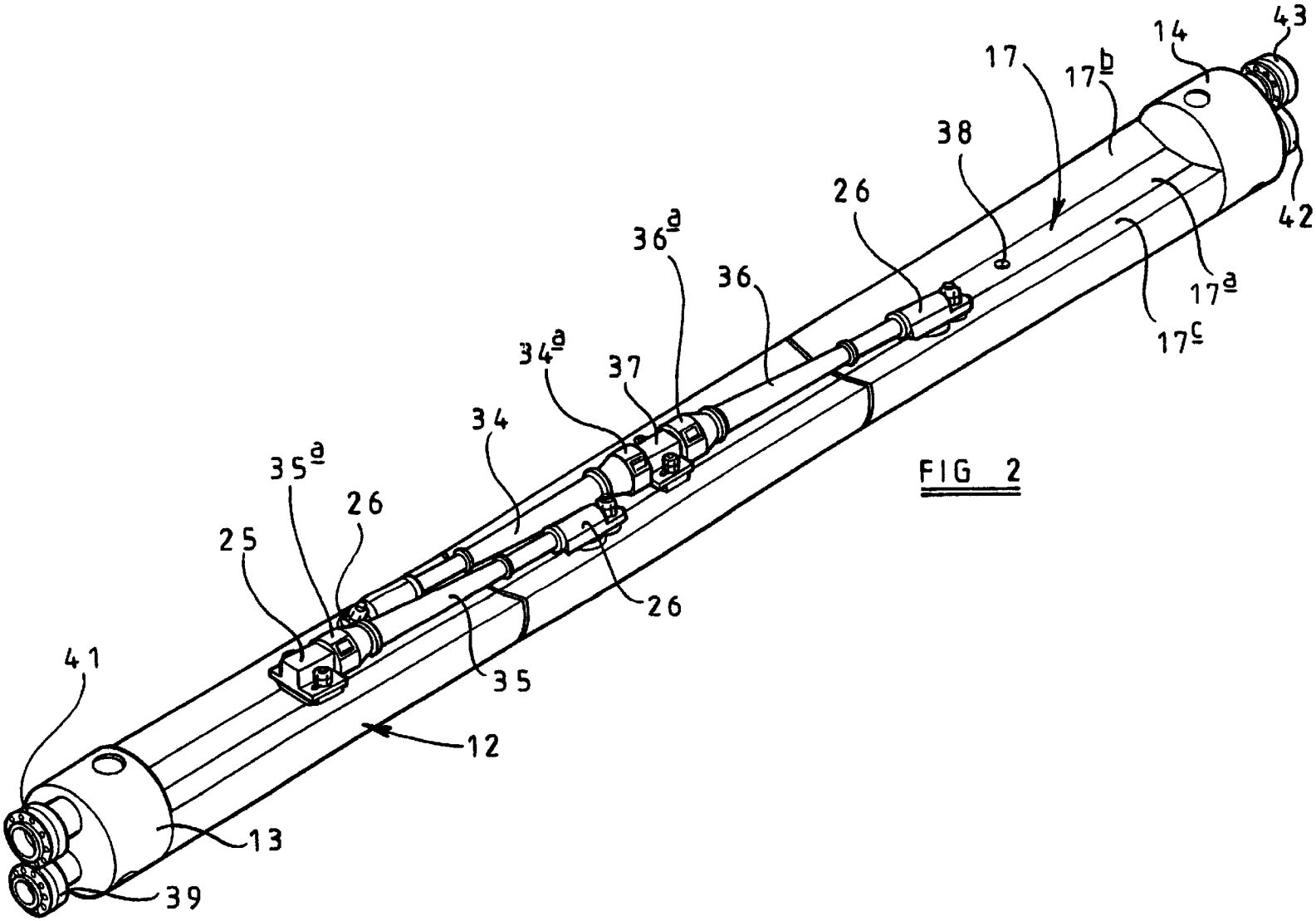
Figure 3:
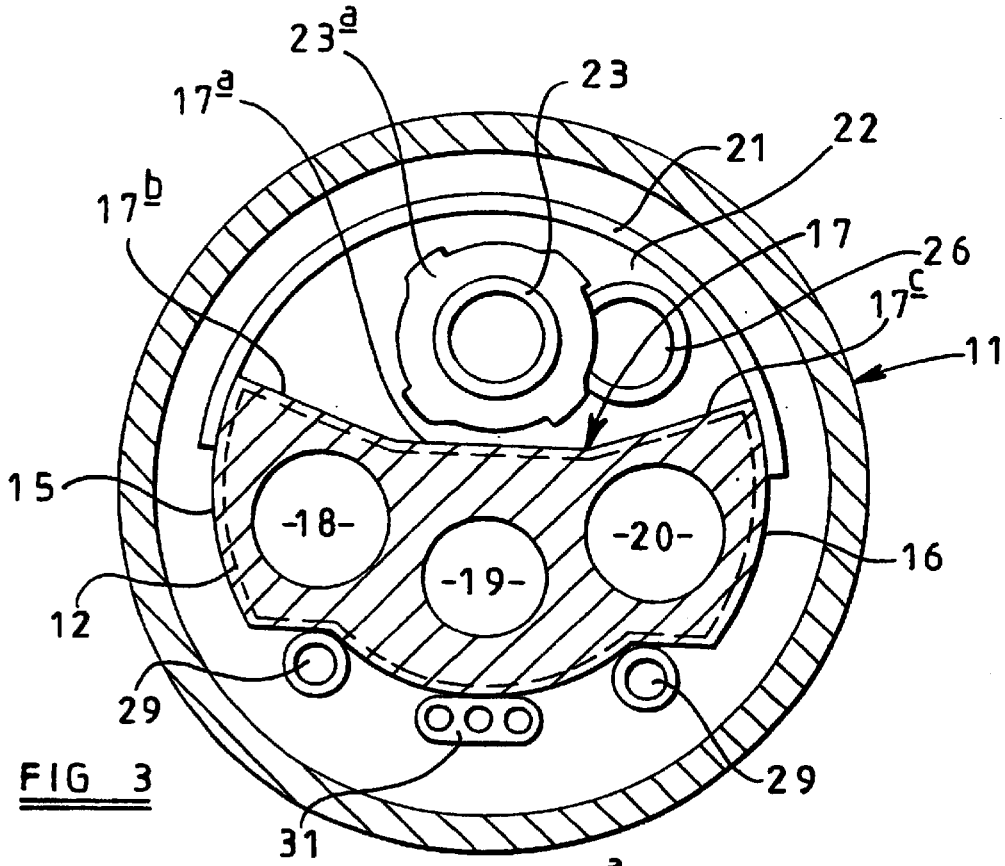
Figure 4:
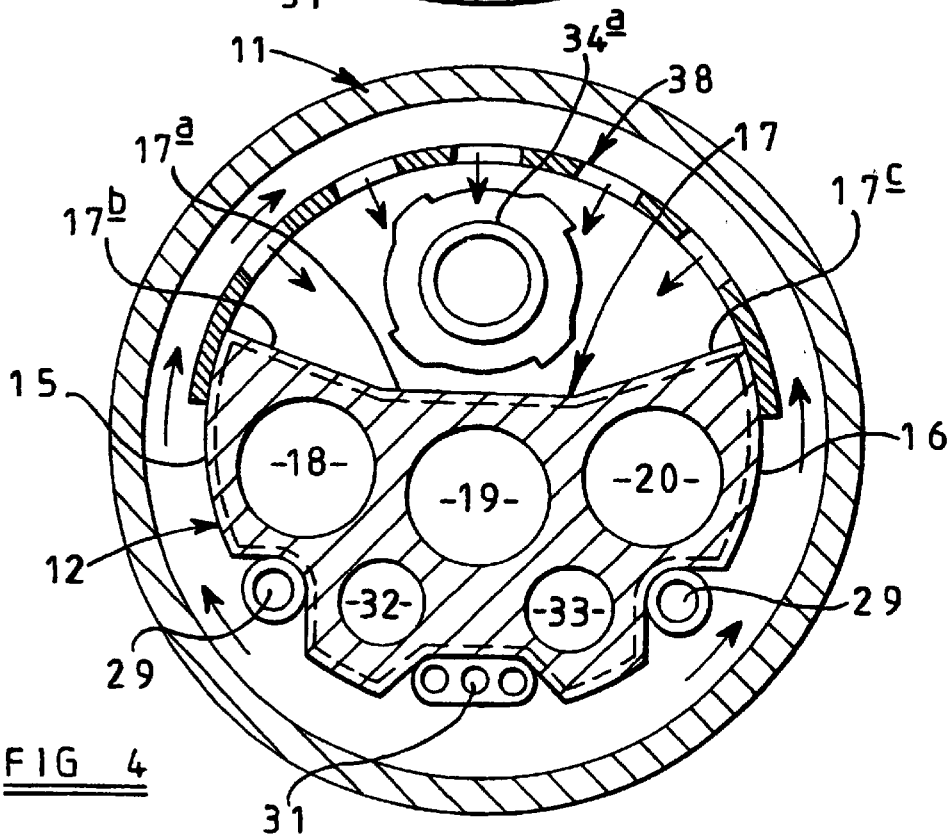
Figure 5:
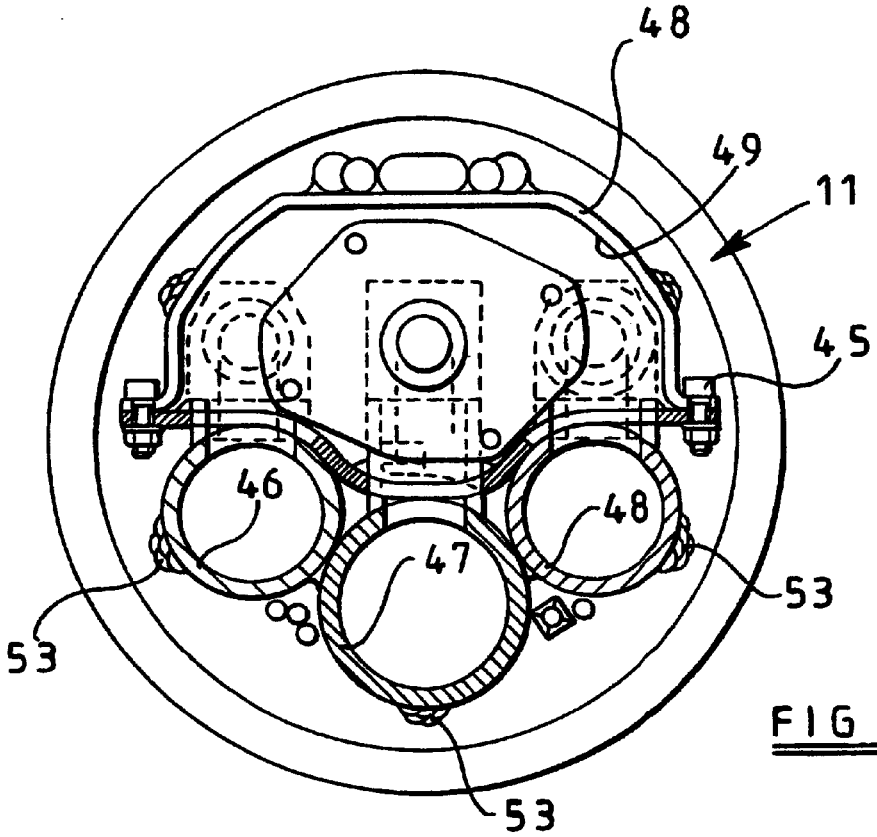
Figure 6:
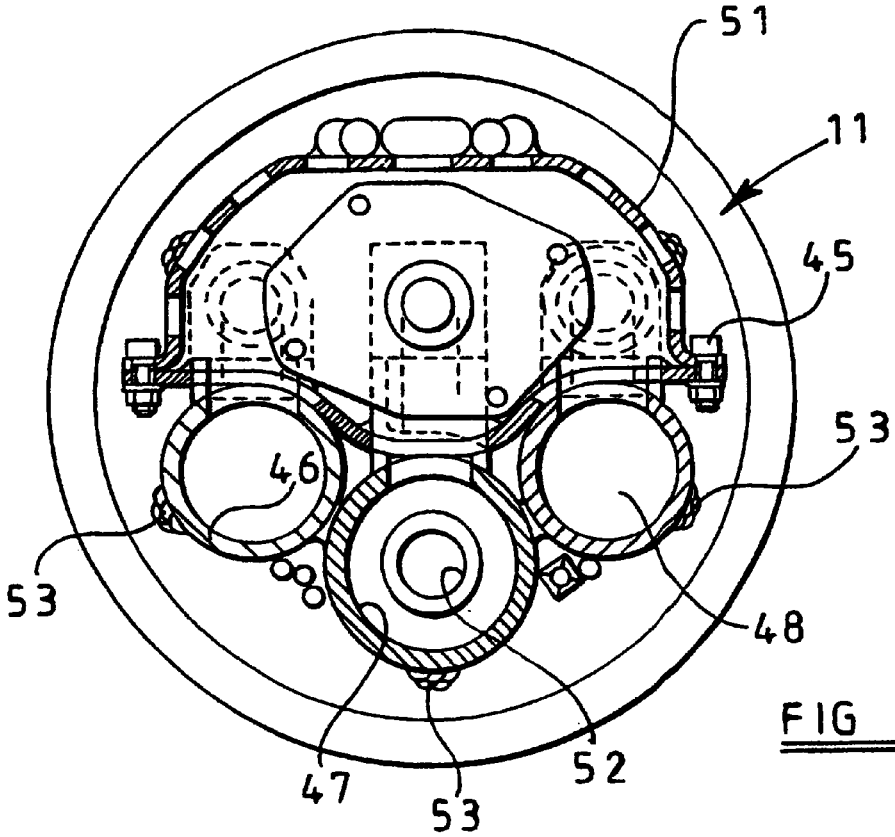

One example of the invention is illustrated in the accompanying drawings wherein:

FIG. 1 is a diagrammatic perspective view, partly exploded, of a pre-deoiler separator assembly, FIG. 2 is a diagrammatic perspective view similar to FIG. 1 of a bulk oil/water separator assembly, FIG. 3 is a transverse cross-sectional view of the separator assembly of FIG. 1, FIG. 4 is a transverse cross-sectional view of the separator assembly of FIG. 2, and FIGS. 5 and 6 are views similar to FIGS. 3 and 4 respectively of an alternative assembly.

In the accompanying drawings, reference numeral 11 denotes the oil well casing, and thus is a component which forms no direct part of the separator assembly. The casing 11 is the fixed liner component of the oil well which is perforated at appropriate points to allow production flow from the oil bearing formation to enter the casing. The internal diameter of the casing 11 governs the maximum external diameter of any component which is to be used 'downhole'.

FIGS. 1 and 3 show a pre-deoiler separator assembly intended for use in an end-to-end relationship with a bulk oil/water separator assembly of the kind illustrated in FIG. 2. However as will be explained in more detail below, with minor changes the pre-deoiler separator assembly could be used alone or connected end-to-end with a further similar assembly. The pre-deoiler separator assembly comprises an elongate body member 12 constituting the main structural support member of the assembly. The elongate body member 12 is of constant cross-section throughout its whole axial length and has cylindrical end bosses 13, 14 secured to opposite axial ends thereof. Conveniently the body member 12 is machined from a solid, elongate steel billet including opposite longitudinally extending side surfaces 15, 16 which are parts of a common imaginary cylinder. Extending generally diametrically of the cylinder of which the surfaces 15, 16 form part, is an elongate, transverse, hydrocyclone mounting surface 17. As is best seen in FIG. 3 the surface 17 is generally planar, but in fact comprises a central planar region 17*a* and inclined planar regions 17*b*, 17*c* at opposite sides thereof, the regions 17*b*, 17*c* being inclined to the plane of the region 17*a* so that the surface 17 is a shallow channel thus maximising the space available to mount hydrocyclones.

The body member 12 is longitudinally bored to form therein three parallel passages 18, 19, 20 extending through the complete length of the body member 12. The three passages 18, 19, 20 are disposed generally side-by-side, but the axis of the centre passage 19 is spaced below a plane containing the axes of the passages 18, 20. The passage 19 lies beneath the region 17*a* of the surface 17 while the passages 18 and 20 lie respectively beneath the regions 17*b* and 17*c*.

The end bosses 13, 14 have an external diameter equal to the diameter of the cylindrical surfaces 15, 16 and are disposed with their axes co-extensive with the axis of the surfaces 15, 16. Passages within the bosses 13, 14 communicate with the passages 18, 19, 20 to connect the passages 18, 19, 20 with predetermined axially extending unions on the outer faces of the bosses 13, 14.

An elongate part cylindrical steel cover 21 is bolted along its longitudinal edges and around its ends to the edges of the surfaces 15, 16 of the body member 12 and to the bosses 13, 14 respectively. The body member 12 and the cover 21, together with the bosses 13, 14 define an elongate substantially cylindrical body the outer diameter of which is less than the inner diameter of the well casing 11. The cover 21 and the body member 12 define between them a chamber 22 one wall of which is constituted by the support surface 17 of the body member 12.

Within the chamber 22 and secured to the surface 17 of the body member 12 are first and second elongate hydrocyclones 23, 24 of known form. The pre-deoiler assembly is designed to process an oil/water, mixture with the objective of minimising the proportion of oil in the underflow of the hydrocyclone, as distinct from a bulk oil/water separator assembly which is designed with the objective of minimising the proportion of water in the overflow of the hydrocyclone. Thus the hydrocyclones 23, 24 are dimensioned to act in a pre-deoiler mode in that they are designed to be fed with an oil rich mixture and to produce underflow containing minimal oil.

Each hydrocyclone has an inlet region adjacent one axial end and indicated in the drawings by the suffix a. At the same end each hydrocyclone has an axially aligned overflow outlet and at its opposite axial end has an axially aligned underflow outlet. The inlet region 23*a*, 24*a* of the hydrocyclones may incorporate a plurality of inlet passages, the inlet passages of the hydrocyclones being open to the interior of the chamber 22. Thus an oil and water mixture flooding the chamber 22 under pressure enters the hydrocyclones 23, 24 through their inlet passages and is separated in known manner to provide an oil rich flow at the overflow outlet of each hydrocyclone and a water rich flow at the underflow end of each hydrocyclone. In fact, the underflow contains a sufficiently small quantity of oil for the underflow to be returned to a suitable strata of the well for disposal and for use in well pressure maintenance.

The arrangement of the hydrocyclones within the chamber 22 can take a number of different forms. A convenient arrangement, which maximises the packing density of hydrocyclones within the chamber 22, is illustrated in FIG. 1. It can be seen that the two hydrocyclones have their axes parallel, but inclined with respect to the longitudinal axis of the body member 12. The inlet end region 24*a* of the hydrocyclone 24 is disposed adjacent the underflow end of the hydrocyclone 23, and both hydrocyclones are positioned with their inlet ends disposed on the region 17*a* of the surface 17.

Each hydrocyclone is secured to the body member 12 by first and second connecting unions 25, 26 which are adjustably bolted to the body member 12. Each union 25 communicates through the region 17*a* with the passage 19 of the body member 12, and couples to the overflow outlet of the hydrocyclone. Thus the overflow outlets of both hydrocyclones discharge into the passage 19. The union 26 of the hydrocyclone 23 is coupled to the underflow outlet of the hydrocyclone 23 and communicates through the region 17*b* of the surface 17, to which it is bolted, with the passage 18. Thus the underflow of the hydrocyclone 23 discharges into the passage 18. The union 26 at the underflow end of the hydrocyclone 24 similarly connects the underflow of the hydrocyclone 24 to the passage 20 so that the underflow of the hydrocyclone 24 discharges into the passage 20.

It will be recognised that in some arrangements it will be possible to fit more than one pair of hydrocyclones between the bosses 13, 14 and in some applications it may be possible to overlap further hydrocyclones so that, for example a hydrocyclone pointing in the same direction as the hydrocyclone 24 may overlap the hydrocyclone 24. The packing density of hydrocyclones in an assembly is governed in part by the hydrocyclone dimensions, but in one example the body member is eleven metres in length and with optimum packing density houses twelve pre-deoiler hydrocyclones.

It will be understood that in a simple application, where the packing density of the hydrocyclones within a separator apparatus is not crucial, it would be possible to dispense with one of the passages 18, 20 and to mount the hydrocyclones with their longitudinal axes aligned with the axis of the body member 12, with the hydrocyclones end-to-end. In such an arrangement the overflows of the hydrocyclones would be connected in the same manner, using unions 25, to the passage 19 while transversely extending unions would connect the underflows of the hydrocyclones to the other remaining passage.

It can be seen from FIG. 1 that the boss 13 has a single axially extending union 27 projecting from its outer face. Within the boss 13 passages 18 and 20 are connected to the union 27 so that the liquid discharged from the underflows of the hydrocyclones passes through the union 27. Conveniently the union 27 will be coupled to the inlet of a pump, the outlet of which re-injects the produced water into the well strata for disposal and/or well pressure maintenance.

Although not apparent in FIG. 1 the boss 14 has two unions protruding from its outer face, one of the unions, 28, is visible in FIG. 1 and it can be seen that the union 28 communicates with the chamber 22. The union 28 receives the underflow from bulk oil/water hydrocyclones (to be described hereinafter) which floods the chamber 22 under pressure to form the inlet fluid entering the hydrocyclones 23, 24. The other union on the outer face of the boss 14 communicates with the passage 19 of the body member 12 and so provides the route for discharge of the oil rich overflow of the hydrocyclones 23, 24.

The face of the body member 12 remote from the surface 17 is cut away as appropriate to provide space within the generally cylindrical profile of the separator assembly, for service pipes and cable ducts 29, 31 extending longitudinally of the assembly.

The bulk oil/water separator assembly illustrated in FIGS. 2 and 4 is similar to the pre-deoiler assembly illustrated in FIGS. 1 and 3, and like parts carry the same reference numerals. It will be seen that the axial end bosses 13, 14 are somewhat larger, and that whereas the body member 12 in FIG. 1 is shown as being formed from two separately machined billets, the body member 12 in FIG. 2 is shown as having been formed from three billets. Naturally the choice of the number of rigidly interconnected components from which the body member is formed is determined by the availability of blanks for machining, the capabilities of the apparatus used for machining, and the overall length of the assembly required. In each case however it is to be understood that the individual components of the body member 12 are rigidly interconnected, and serve as if they were integral with one another.

The body member 12 of the bulk oil/water separator assembly is very similar to that of the pre-deoiler assembly with the exception that it contains a pair of additional passages 32, 33 disposed at the far side of the passages 18, 19, 20 from the surface 17. The hydrocyclones used in a bulk oil/water separator are designed to operate in a bulk separation mode in that their objective is to produce an overflow containing minimal water content. As is apparent from a comparison of FIG. 2 with FIG. 1, for a similar inlet region size, of shorter axial length than the hydrocyclones used in a pre-deoiler separator assembly and generally therefore it is possible to accommodate more hydrocyclones in a bulk oil/water assembly than in a pre-deoiler assembly. For example using a similar packing density as used above in relation to a pre-deoiler assembly and using hydrocyclones of similar capacity, twenty one bulk hydrocyclones can be accommodated on the same length body member. FIG. 2 illustrates a pair of bulk oil/water hydrocyclones 34, 35 in the same overlapping arrangement as the hydrocyclones 23, 24 of FIG. 1. However, FIG. 2 shows a further hydrocyclone 36 positioned axially aligned with the hydrocyclone 34 and having its overflow end positioned adjacent the overflow end of the hydrocyclone 34. The union 37 which connects the overflow of the hydrocyclone 34 to the passage 19 of the body member 12 differs from the union 25 associated with the overflow end of the hydrocyclone 35 in that it secures the overflow ends of both hydrocyclones 34 and 36 to the body member 12, and provides communication for both overflows to discharge into the passage 19. In effect therefore the union 37 is a double union common to both hydrocyclone 34 and 36, but it will be recognised that if desired two separate but closely positioned unions 25 could be utilised.

Although not shown in FIG. 2 a further hydrocyclone, similar to the hydrocyclone 35 but oppositely orientated would be positioned alongside the hydrocyclone 36, the aperture 38 in the region 17*a* of the surface 17 communicating with a union 25, or 37 associated with the further hydrocyclone to route its overflow into the channel 19. It will be recognised that space constraints permitting then further hydrocyclones can be positioned along the length of the surface 17, all having their overflows discharging into the passage 19, and having their underflows discharging into the passage 18 or the passage 20.

It will be recognised that the 'head to head' interconnection of hydrocyclones as illustrated with reference to hydrocyclones 34 and 36, can, if desired be used in conjunction with pre-deoiler hydrocyclones in a pre deoiler assembly. Furthermore, the axial arrangement of end to end hydrocyclones described above in relation to the pre-deoiler hydrocyclone assembly could be utilised in a bulk oil/water hydrocyclone assembly.

It will be noted that there is no equivalent of the cover 21 in the assembly shown in FIG. 2. The reason for this is that the hydrocyclones of the bulk oil/water separator assembly operate directly on the production flow from the oil bearing strata of the oil well which floods the casing 11. Thus the inlets of the hydrocyclones of the bulk oil/water separator assembly are exposed directly to the production flow which enters the inlets of the hydrocyclones and is separated by the hydrocyclones to provide an oil rich fluid entering the passage 19 of the body member 12 from the overflow outlets of the hydrocyclones, and an oil depleted fluid (watery flow)

which discharges from the underflows of the hydrocyclones into the passages 18, 20 and which is routed to pre-deoiler cyclone assemblies for further processing.

FIG. 4 shows that a part cylindrical, protective screen 38, similar in shape to the cover 21, but very heavily perforated, may be fitted to the bulk oil/water assembly to provide physical protection for the hydrocyclones. However, the screen 38 does not impede the flow of production fluids from the casing 11 into the inlets of the hydrocyclones.

The boss 13 at the end of the assembly which is lowermost in use has a pair of axially extending unions 39, 41 for connection to the adjacent, lower, pre-deoiler assembly as illustrated in FIGS. 1 and 3. The union 39 receives the oil rich flow from the respective passage 19 and routes it into the passages 32, 33 of the body 12 of the bulk oil/water assembly. The union 41 receives the oil depleted flow from the passages 18, 20 of the bulk oil/water separator assembly and directs it through the union 28 into the chamber 22 of the pre-deoiler assembly. The boss 14 at the opposite end of the pre-deoiler assembly again has a pair of unions 42, 43, the union 42 communicating with the passages 32, 33 and the union 43 communicating with the passage 19. It will be recognised that although the flow from the overflows of the hydrocylones of the pre-deoiler assembly is to be merged with the flow from the overflows of the hydrocyclones of the bulk oil/water assembly, the pressure at the overflows of the hydrocyclones of the bulk oil/water assembly is higher than that at the overflow outlets of the hydrocyclones of the pre-deoiler assembly, and thus at some point the pressures must be matched either by pumping the flow in the passages 32, 33 into the flow in the passage 19 or alternatively by throttling the pressure of the flow in the passage 19 to match the pressure in the passages 32, 33, for example by the inclusion of a restrictor in the flow path upstream of the point at which the flows merge.

Referring now to FIGS. 5 and 6 there are shown pre-deoiler and bulk oil/water separator assemblies in which the machined, unitary body member 12 of the examples described above, is replaced by a fabricated assembly comprising an elongate, shallow channel-shaped steel plate 45 to the convex surface of which are anchored three elongate steel tubes 46, 47, 48 serving the functions of the passages 18, 19, 20 respectively. The unions which secure the hydrocyclones to the plate 45 are similar to the unions described above with reference to the body member 12, and are attached to respective hollow spigots (not shown) welded to the plate 45 and respective tubes 46, 47, 48, the spigots extending through the plate and the tube walls to place the hydrocyclone outlets in communication with the respective tubes.

FIG. 5 illustrates that a cover member 49 similar to the cover member 21 is secured to the plate 45 to define a chamber 49 housing the hydrocyclones of the pre-deoiler assembly, whereas in the bulk oil/water separator assembly illustrated in FIG. 6 the cover 48 is replaced by a perforated screen 51. Operatively however the arrangements illustrated in FIGS. 5 and 6 are substantially identical to those illustrated in FIGS. 1 and 3 and 2 and 4 respectively. At their ends the tubes 46, 47, 48 are connected to axially extending unions as appropriate to effect external connections to the separator assembly as described above in relation to the unions of the bosses 13, 14.

In FIG. 6 it can be seen that the tube 47 houses a further tube 52 preferably disposed concentrically within the tube 47. The tube 52 serves the function of the passages 32 and 33 in FIG. 4, and it is to be understood that if desired the passage 19 of the arrangement illustrated in FIGS. 2 and 4 could house a concentric tube similar to the tube 52 and replacing the passages 32 and 33. The assemblies of FIGS. 5 and 6 include end bosses equivalent to the bosses 13 and 14 described above for making connections to the interior of the tubes 46, 47, 48, and where appropriate to the tube 52 and the chamber 49. Although circular cross-section tube is preferred for the tubes 46, 47, 48, other cross-sections such as rectangular or triangular could be utilised.

While the fabricated arrangements illustrated in FIGS. 5 and 6 are in some senses less robust than the assemblies utilising unitary body members 12, they have the advantage of greater flexibility, and therefore the ability to follow more tortuous well bores. Sacrificial wear elements 53 may be welded to the outermost regions of the tubes 46, 47, 48 to protect the tubes from abrasion by the well casing 11 as the assemblies are introduced downhole.

In certain wells there is no need for a bulk oil/water assembly and a pre-deoiler assembly will suffice alone. In such an arrangement the cover 21 is replaced by a screen 38 so that the inlets of the hydrocyclones of the pre-deoiler assembly can directly receive the production flow. The union 28 is redundant and the remaining union of the boss 14 is coupled to the means for transporting the oil rich mixture to the surface. Sometimes it may be desirable to couple two pre-deoiler assemblies end-to-end to increase the processing capacity and here the adjacent bosses of the two assemblies are arranged so that the passages 19, and 18, 20 of the two interconnected assemblies are in effect continuous.

It will be recognised that amount of fluid in the passages 18, 19, 20 (and tubes 46, 47, 48) increases downstream owing to downstream hydrocyclones augmenting the output of those further upstream in the assembly. To accommodate this effect the passages (and tubes) can be tapered to be of increasing diameter in the downstream direction.

As an alternative to boring the passages 18, 19, 20 in the billets of the body members 12 one or more of the passages could be formed by machining a respective groove in the surface 17 and the welding an elongate cap over the groove to define a passage. As an alternative the billet could be longitudinally split or formed in longitudinal parts, one or both of two adjacent parts being machined to produce therein a longitudinal groove defining a passage when the two parts are welded together.

The pattern in which hydrocyclones are mounted on the surface of the body member 12 is determined in part by their length and inlet region configuration. However a convenient pattern involves positioning hydrocyclones in a zig-zag row, overflow to overflow and underflow to underflow. Both the paired overflows and the paired underflows can share respective common unions arranged to accommodate hydrocyclones at an acute angle to one another. In such an arrangement all the underflow unions align with the same passage 18 or 20 (or tube 46 or 48) and so only one of those passages is needed. However if desired one or more additional zig-zag rows of hydrocyclones can be positioned with their underflow unions aligned along the other of the passages and their overflow unions aligned with and interspaced between the unions of the first zig-zag row.

While the primary objective of the above separator constructions is the provision of downhole separation, it is to be recognised that since such separator constructions provide a compact packaging of hydrocyclones permitting the use of containment vessels of small diameter and thin wall thickness and thus affording significant weight saving over conventional designs, such constructions could also be used in seabed, topside, and land based separator assemblies.

What is claimed is:

1. A separator assembly having an elongate body structure including a longitudinally extending oil passage and first and second longitudinally extending water passages extending substantially parallel to said oil passage, the elongate body structure defining a longitudinally extending assembly to which at least first and second hydrocyclones are secured, said hydrocyclones each having a longitudinal axis, an underflow outlet at one axial end of the hydrocyclone and an overflow outlet at the opposite axial end of the hydrocyclone, the first and second hydrocyclones being positioned side by side, extending in opposite directions, with their longitudinal axes parallel and inclined to the length of said elongate body structure, a first connecting union at the overflow outlet end of each hydrocyclone whereby the overflow outlet of each hydrocyclone communicates with said oil passage of said body structure, a second connecting union at the underflow outlet end of each hydrocyclone whereby the underflow outlet of said first hydrocyclone communicates with said first water passage of said elongate body structure and the underflow outlet of said second hydrocyclone communicates with said second water passage of said elongate body structure, and, connecting means at at least one axial end of the elongate body structure for establishing communication with said oil and water passages.

2. A separator assembly having an elongate body structure including a longitudinally extending oil passage and first and second longitudinally extending water passages extending substantially parallel to said oil passage, the elongate body structure defining a longitudinally extending assembly to which at least first and second hydrocyclones are secured, said hydroclones each having a longitudinal axis, an underflow outlet at one axial end of the hydrocyclone and an overflow outlet at the opposite axial end of the hydrocyclone, the first and second hydrocyclones being positioned end to end with their overflow outlets proximate one another and their longitudinal axes coextensive and inclined to the length of said elongate body structure, a first connecting union at the overflow outlet end of each hydrocyclone whereby the overflow outlet of each hydrocyclone communicates with said oil passage of said body structure, a second connecting union at the underflow outlet end of each hydrocyclone whereby the underflow outlet of said first hydrocyclone communicates with said first water passage of said elongate body structure and the underflow outlet of said second hydrocyclone communicates with said second water passage of said elongate body structure, and, connecting means at least one axial end of the elongate body structure for establishing communication with said oil and water passages.

3. An assembly as claimed in claim 2, wherein said first and second connecting unions provide the means of securing each hydrocyclone to the elongate body structure.

4. An assembly as claimed in claim 2, wherein a third hydrocylone is secured to said elongate body structure with its longitudinal axis parallel to the axis of said first hydrocyclone, said first and third hydrocyclones overlapping in side-by-side relationship and extending in opposite directions, the overflow outlets of the first and third hydrocyclones being aligned with one another lengthways of the body structure so that their connecting unions communicate with the oil passage, while the connecting unions at the underflow ends of the first and third hydrocyclones communicate with the first and second water passages respectively.

5. An assembly as claimed in claim 2, wherein said elongate body structure includes opposite, axially aligned, end bosses of circular cylindrical form.

6. An assembly as claimed in claim 2, wherein an inlet of each hydrocyclone is an exposed inlet.

7. An assembly as claimed in claim 6, wherein said hydrocyclones are configured to be bulk oil/water hydrocyclones the assembly being exposed in use to the production flow within a well casing of a hydrocarbon well, such that production flow enters said-exposed inlets of the hydrocyclones.

8. An assembly as claimed in claim 6, wherein said hydrocyclones are configured to operate as pre-deoiler hydrocyclones, the assembly including a cover member sealingly engaged with the elongate body structure to define therein an inlet chamber which, in use, is flooded through an inlet passage with the oil/water mixture to be separated.

9. A downhole separator string comprising a plurality of separator assemblies as claimed in claim 2, interconnected with their elongate body structures in end-to-end relationship.

10. A downhole separator string as claimed in claim 9, having at least one pre-deoiler separator assembly and at least one bulk oil/water separator assembly, said or at least one pre-deoiler separator assembly being positioned lower in the string, in use, than said at least one bulk oil/water separator assembly, the underflow of said at least one bulk oil/water separator passing down the string to said at least one pre-deoiler separator assembly, and the oil overflow of said at least one pre-deoiler separator passing upwardly through the string to be mixed with the oil overflow of said at least one bulk oil/water separator for transport to the surface.

11. A downhole separator string as claimed in claim 9 wherein said body structure of said at least one bulk oil/water separator assembly includes an additional oil passage through which oil from said at least one pre-deoiler separator assembly lower down the string is transported upwardly.

12. A downhole separator string as claimed in claim 11, wherein said additional oil passage is housed within the first mentioned oil passage of the elongate body structure of said at least one bulk oil/water separator assembly.

* * * * *